US005486211A

United States Patent [19]

Glidden, Sr.

[11] Patent Number: 5,486,211

[45] Date of Patent: Jan. 23, 1996

[54] WOOL PURIFICATION

[76] Inventor: John L. Glidden, Sr., 6 Mill St., Ashland, N.H. 03217

[21] Appl. No.: 312,135

[22] Filed: Sep. 26, 1994

[51] Int. Cl.[6] ..... D06L 1/02; D06L 1/08

[52] U.S. Cl. ..... 8/142; 8/137; 8/139.1; 8/141; 252/162

[58] Field of Search ..... 8/137.5, 139, 139.1, 8/142; 252/8.6, 162

[56] References Cited

U.S. PATENT DOCUMENTS

| | | | |
|---|---|---|---|
| 1,035,815 | 8/1912 | Stockhausen | 8/139.1 |
| 1,117,194 | 7/1914 | Koch | 8/139.1 |
| 1,358,163 | 11/1920 | Koch | 8/139.1 |
| 1,780,885 | 6/1926 | Pfaffendorf | 8/139.1 |
| 2,137,823 | 11/1935 | Neusslein et al. | 8/139.1 |
| 2,176,705 | 2/1939 | Derby | 8/139.1 |
| 2,717,901 | 1/1951 | Norman | 8/139.1 |
| 3,458,273 | 7/1969 | Case et al. | 8/139.1 X |
| 3,619,116 | 11/1971 | Saville | 8/139.1 |
| 3,871,820 | 3/1975 | Stewart et al. | 8/139 |
| 4,128,398 | 12/1978 | Alpert | 8/127.6 |
| 4,168,143 | 9/1979 | Wood | 8/139 |
| 4,207,244 | 6/1980 | Chaikin et al. | 260/397.25 |
| 4,288,377 | 9/1981 | Arutjunian et al. | 260/397.25 |
| 4,859,332 | 4/1987 | Hellsten | 8/142 |
| 5,196,132 | 3/1993 | Mains et al. | 252/90 |

OTHER PUBLICATIONS

Proceedings of the May, 1993 American Sheep Industry Association, Polypropylene Contamination Summit.

*Primary Examiner*—Margaret Einsmann

*Attorney, Agent, or Firm*—Hayes, Soloway, Hennessey, Grossman, & Hage

[57] ABSTRACT

A process of producing purified fabric substantially free of polyolefin contamination comprising the steps of supplying a fabric containing polyolefin contamination, selecting a solvent which selectively solubilizes the polyolefin wherein said solvent solubilizes polyolefin at temperatures and pressures that do not degrade the fabric, treating the fabric with said selected solvent to solubilize the polyolefin and removing the solvent containing solubilized polyolefin contamination and recovering purified fabric.

9 Claims, 3 Drawing Sheets

WOOL PURIFICATION

BACKGROUND OF THE INVENTION

This invention relates to a process of producing purified fabric, particularly wool fabric, substantially free of polyolefin contamination.

FIELD OF INVENTION

DESCRIPTION OF PRIOR ART

The prior art is replete with various disclosures outlining various methods and apparatus for use in wool scouring operations. For example, in U.S. Pat. No. 3,871,820, there is described a method and apparatus for use in wool scouring operations and the treatment of the aqueous scouring liquids after and during use to extract recoverable lanolin or wool grease and heat from such liquids, and separate solid and extraneous matter from the liquids prior to discharge. The method and apparatus described therein provides for removal of excess liquid from the wool scouring tank, passage of hot liquid and suspended solids from the wool and main scouring tank to a side tank, recycling of liquids from which solids have precipitated and passage of the solids to a heavy solids settling tank via a dump tank, removal of heavy solids precipitated in the settling tank and passage of the remaining liquid through a lanolin extractor; and recycling the remaining liquid or discharging all or part of such remaining liquid to waste via a heat exchanger which recovers heat from the discharged liquid for heating fresh water, or liquid.

In U.S. Pat. No. 4,128,398, there is described a processing aid that is used to improve worsted woolen processes. Examples of processing aids disclosed therein include polyamides, epoxidized polyamids, epoxidized polyamines, polyacrylimides, polyacrylic acid, aminoplast resins, and others.

In U.S. Pat. No. 4,168,143, there is described a process and apparatus for the purification and re-use of wool-scouring liquors. In U.S. Pat. No. 4,288,377, there is described a process for purification of wool grease. In U.S. Pat. No. 4,207,244, there is described a process for separation of wool wax from fats in wool grease or mixtures containing wool grease.

As can be seen from the above prior art, there have been no reports regarding what has been a long standing problem in the manufacturing and processing of wool fibers. That is, it is well known that raw stock wool fiber when it is packaged and shipped is bound in bales with polyolefin based yarn, specifically polypropylene, which contaminates the wool in subsequent processing. The cost of manually removing the polypropylene and the quality problems associated with contamination have plagued the wool industry and have added significantly to the cost of providing higher grade wool products.

In fact, in May of 1993, the American Sheep Industry Association held a conference entitled "Polypropylene Contaminations Summit". In the proceedings of this meeting, it was confirmed that the contamination with polypropylene has occurred since the advent of its use as a forage packaging material. It was pointed out that polypropylene, owing to its strength, is an ideal material for forage packaging. However, this excellent strength also allowed polypropylene to remain in the environment and its fibrillar nature was found to be ideal for adhering to sheep wool. Accordingly, the universal use of polypropylene for bailing twine has made it a world problem and source of contamination. See, *Quantifying Wool-Polypropylene Contamination At The Farm/Ranch*, by Dr. Wayne Cunningham, Proceedings of the May, 1993 American Sheep Industry Association, Polypropylene Contamination Summit. Some proposed solutions include the production or purchase of feeds that are packaged with sisal or wire, and removal of polypropylene from facilities and working area. Other suggestions were to assure that no polypropylene bags or tarps were used to move sheep to shearing facilities, to avoid using polypropylene tarps for handling fleece, and to use burlap wool bale containers.

Accordingly, it is an object of this invention, to chemically remove polyolefin from wool or cashmere fabric and not damage or degrade the primary fiber beyond an acceptable level.

In particular, it is an object of this invention to produce a purified fabric substantially free of polyolefin contamination wherein the polyolefin contamination is removed by a solvent and under conditions that do not degrade the fabric.

Finally, it is a more specific object of this invention to provide a process of producing purified wool fabric which is essentially free of polypropylene contamination by treating the wool with a chlorinated hydrocarbon solvent at temperatures and pressures that do not degrade the wool and which provide a purified wool material for further processing into a high quality wool material.

SUMMARY OF THE INVENTION

The present invention is directed at a process of producing purified fabric substantially free of polyolefin contamination comprising the steps of supplying a fabric containing polyolefin contamination, selecting a solvent which selectively solubilizes the polyolefin wherein said solvent solubilizes polyolefin at temperatures and pressures that do not degrade the fabric, treating the fabric with said selected solvent to Solubilize the polyolefin and removing the solvent containing solubilized polyolefin contamination and recovering purified fabric.

LIST OF FIGURES

FIG. 1 s a plot of per-cent polypropylene removal v. temperature, after 20 minutes of exposure to the indicated solvents, in case of a wool fabric. FIG. 2 is a plot of per-cent polypropylene removal v. temperature, after 45 minutes of exposure to the indicated solvents, in the case of a wool fabric.

FIG. 3 is a drawing of a device used in the process of producing purified wool fabric in accordance with the invention disclosed herein.

DETAILED DESCRIPTION OF THE PREFERRED EMBODIMENTS

In a preferred embodiment, the present invention is directed at a process of producing purified wool fabric substantially free of polypropylene contamination comprising the steps of supplying a wool fabric containing polyolefin contamination, selecting a solvent which selectively solubilizes the polyolefin wherein said solvent solubilizes polyolefin at temperatures and pressures that do not degrade the fabric, wherein said solvent is preferably a chlorinated hydrocarbon solvent, most preferably trichloroethane and perchloroethylene. The fabric is then treated with said selected solvent to solubilize the polypropylene. Next, the solvent containing solubilized polyolefin contamination is separated and removed from the fabric, which leaves a purified fabric material.

The most preferred solvent for purification has been found to be perchloroethylene. That is, under identical conditions of time and temperature exposure, perchloroethylene has a definite advantage over 1,1,1-trichlorethane.

In general, the temperature range for purification was found to be between 175°–235° F. The time range for purification ranges from 20–40 minutes, in a sealed vessel, thereby producing a small amount of internal pressure, in the neighborhood of 25–200 psi.

Treatment of the wool under the above described conditions does not result in significant degradation to wool, whereby the wool can be purified in a manner that does not result in destruction or degradation of the wool fiber integrity (i.e., the ability of the wool to be employed in a typical end-use application).

Figure 3:
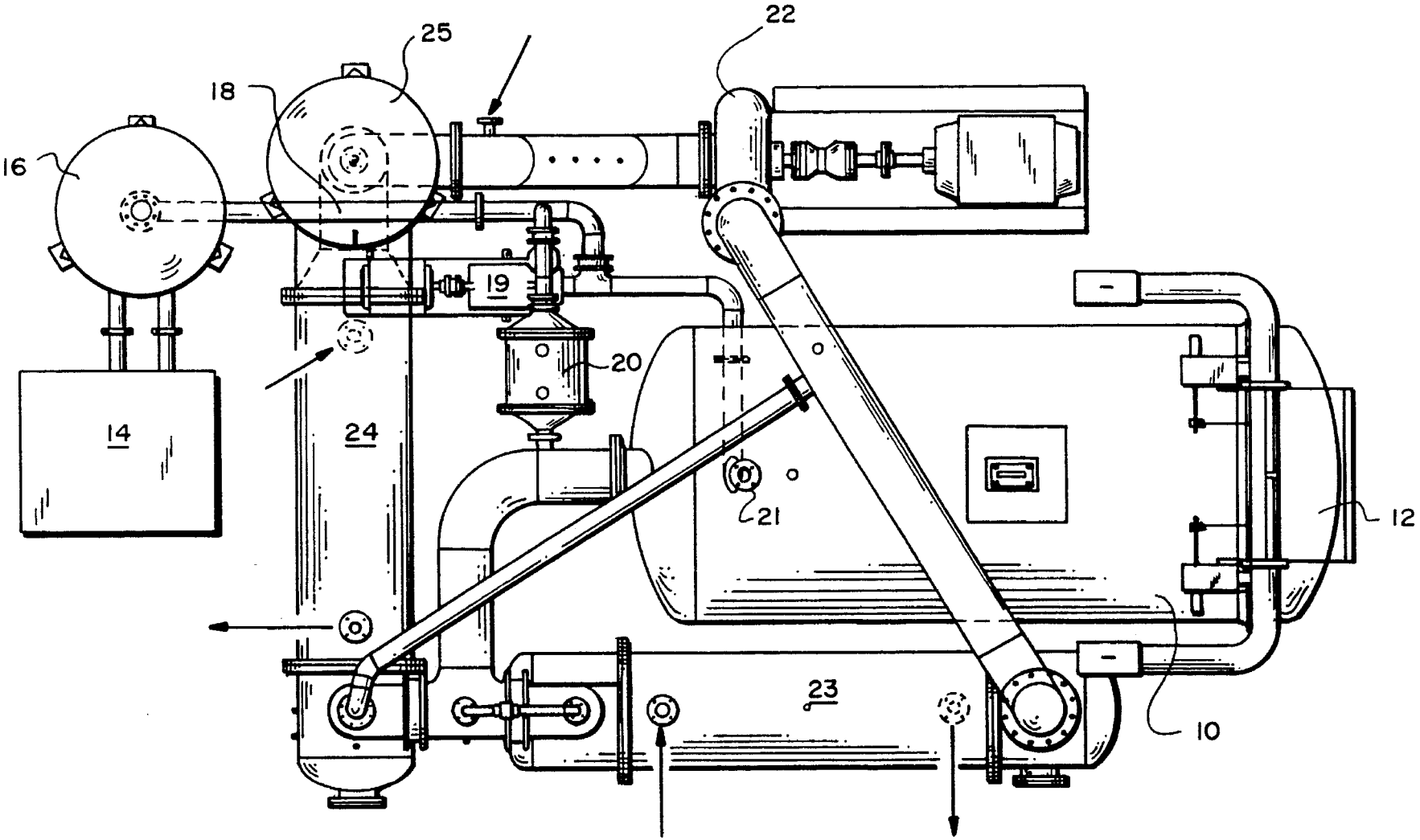

With reference to FIG. 3, a drawing is provided which illustrates the purification of the wool, in a large scale process which is made readily available by the process of the instant invention.. A large receiving vessel (10) contains a opening door (12) and is designed to receive samples as large as an 800 pound roll of fabric. The fabric is placed in the vessel and the door (12) is sealed.

The process of continuous solvent extraction is as follows:

Solvent is maintained in a chemical reservoir (16). This solvent is pumped into the receiving vessel using the pump shown (19). Once the vessel is filled to the desired level, the same pump is used to circulate the solvent through the cloth. As it circulates, it passes through the heat exchanger (20) where it is heated by steam, the temperature required for the reaction to take place. When the reaction is complete, the same pump is used to drain (21) the vessel and return the solvent to the chemical reservoir. (The same heat exchanger can be used to cool the solvent before draining if this is necessary).

At this point in the process, residual chemicals remain in the cloth. These chemicals are removed by circulating air heated above 160 degrees F through the cloth. At this temperature the solvent will vaporize. The blower (22) circulates the air through the heat exchanger (23) and then through the cloth. The hot air exiting the vessel then passes through the condenser (24) where it is cooled. The liquid solvent is collected in the bottom of the separator (25) where it is drained through a separate line (not shown) back to the chemical reservoir. This heating and cooling process insures that all solvent is recaptured before the receiving vessel is opened to remove the cloth.

To purify the solvent so that it can be reused, it is periodically circulated through the distillation unit (14) where impurities are removed and collected for proper disposal.

Of course, other solvents may be employed within the broad scope of the present invention, provided one follows the general criterion described herein: i.e. choosing a solvent that can selectively dissolve a polyolefin and which can do so under condition that are not destructive to the wool material.

Furthermore, it can be appreciated that the invention described herein can be applied to any fiber stock which contains polyolefin based contamination, and can be applied at any convenient point in a given production/purification process. For example, cashmere, camel hair, alpaca and angora fiber can all be purified in the manner described above, and the chemical purification of such fibers would result in the production of a higher qualify finished fiber, in a manner similar to that mentioned above for the case of wool fibers. The process will also be applicable to raw stock fiber, yarn, griege goods, knits, including woven and non-woven goods.

EXAMPLES

By way of the following examples, the following data was obtained by operation of the purification method of this invention:

EXAMPLE 1

A known sample of polypropylene was attached mechanically to a 10 gram sample of 100% woven wool and then subjected to various temperatures and times in a sealed vessel placed in an AHIVA-type device, which is a commonly used vessel for controllably heating the contents therein. Specific conditions included a 15:1 solvent to sample weight ratio. Samples were then removed from the solvent bath, extracted and dried in an oven at a temperature not exceeding 200° F. Both 1,1,1-trichloroethane and perchloroethylene were employed. The temperature range was from 175°–235° F. The time of exposure to the solvents was from 20–45 minutes. The sample size was 4.0 by 8.0 inches wool swatch.

After the samples were thoroughly dried, polypropylene removal was evaluated visually against the original sample and rated as a % dissolution of polypropylene.

The results were as follows: in the case of 1,1,1-trichloroethane and perchloroethylene, under identical conditions of time and temperature exposure conditions, perchloroethylene had a definite advantage over 1,1,1-trichloroethane. In the case of perchloroethylene, the minimum 100% removal of polypropylene was obtained in 45 minutes at 212° F. At a temperature of 230° F, 100% polypropylene removal was achieved in 20 minutes.

In the case of 1,1,1-trichloroethane, 100% polypropylene was removed in 45 minutes at a temperature of 220° F. At a temperature of 230° F, 100% polypropylene removal was achieved in 20 minutes.

Figure 1:
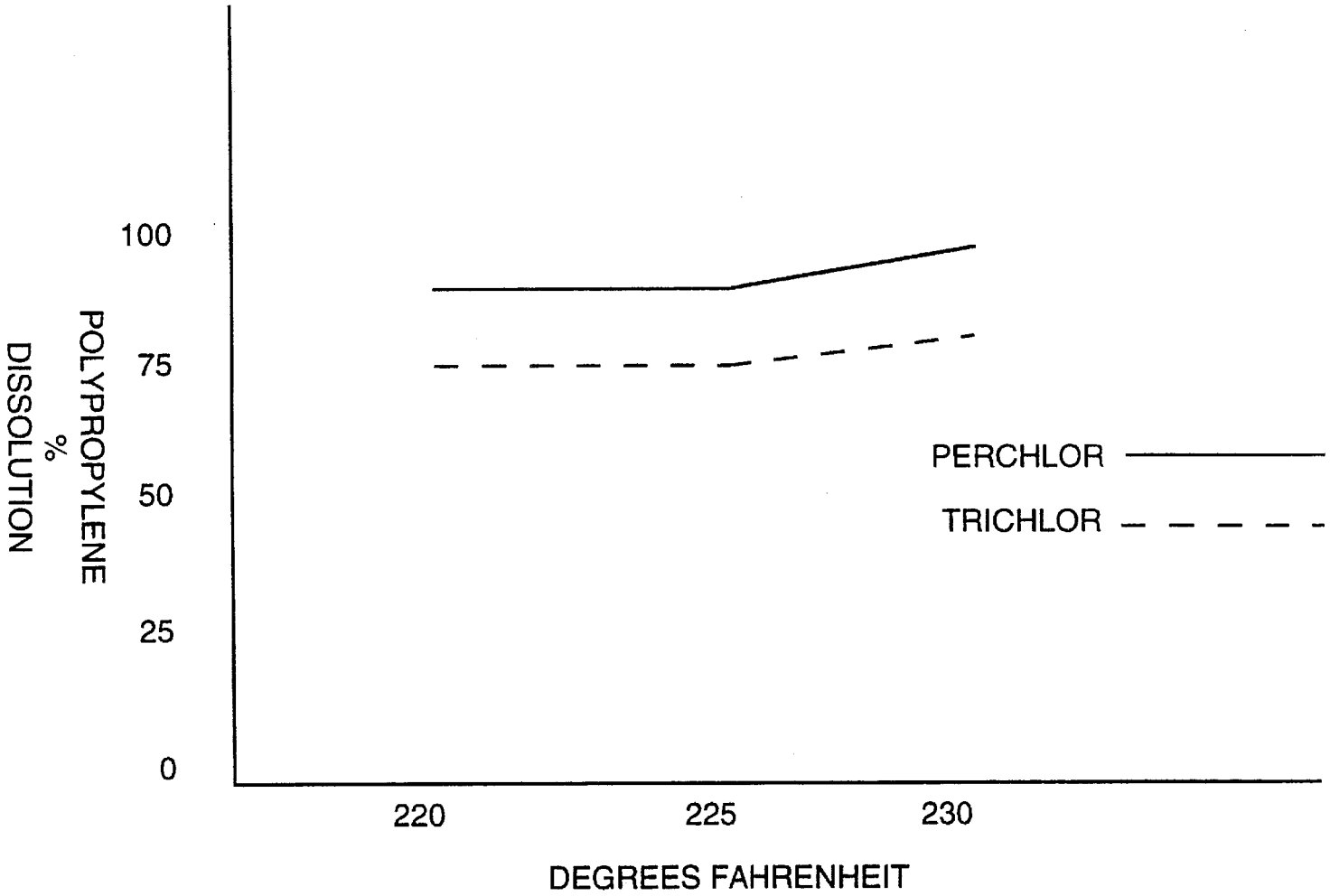

With reference to FIG. 1, a plot has been made of polypropylene removal v. temperature for both perchloroethane, and 1,1,1-trichloroethane, at a constant time of exposure of 20 minutes. As can be seen from this figure, perchloroethane provided more efficient removal of polypropylene, over the indicated temperatures.

Figure 2:
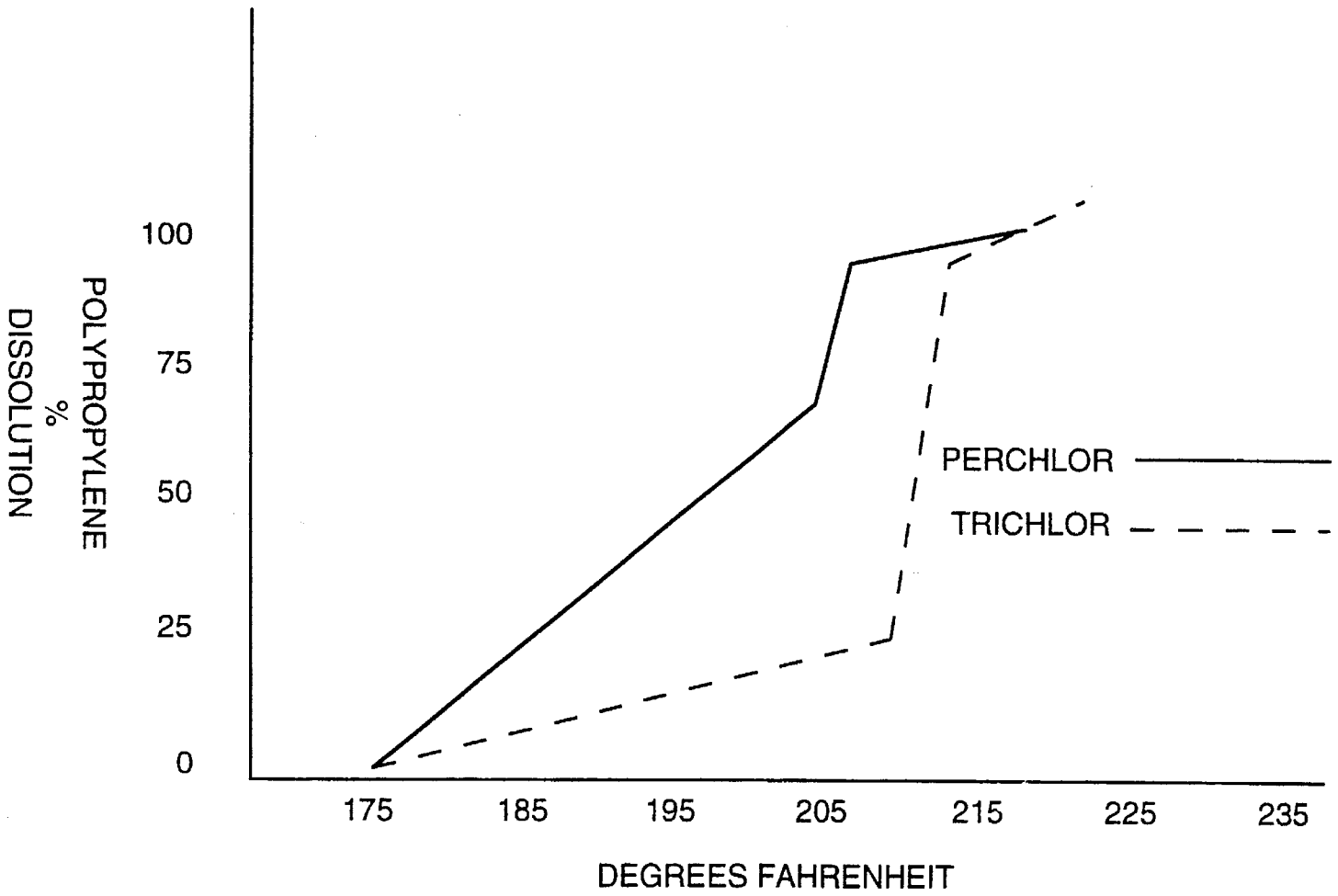

FIG. 2 shows a plot of polypropylene removal v. temperature, again for both perchloroethane, and 1,1,1-trichloroethane, at a constant time exposure of 45 minutes. Under these conditions, once again, perchloroethane indicated more rapid removal of polypropylene at the indicated temperature (175°–225° F).

In connection with the above examples, sixteen samples were collected and tested for mechanical strength. The samples are identified as follows:

| SOLVENTS | CONDITIONS |
|---|---|
| 1. TRICHLOR | (175° F./45 min) |
| 2. PERCHLOR | (175° F./45 min) |
| 3. TRICHLOR | (205° F./45 min) |
| 4. PERCHLOR | (205° F./45 min) |

-continued

| SOLVENTS | CONDITIONS |
|---|---|
| 5. TRICHLOR | (210° F./45 min) |
| 6. PERCHLOR | (210° F./45 min) |
| 7. TRICHLOR | (215° F./45 min) |
| 8. PERCHLOR | (215° F./45 min) |
| 9. TRICHLOR | (220° F./45 min) |
| 10. PERCHLOR | (220° F./45 min) |
| 11. TRICHLOR | (220° F./45 min) |
| 12. PERCHLOR | (220° F./45 min) |
| 13. TRICHLOR | (225° F./45 min) |
| 14. PERCHLOR | (225° F./45 min) |
| 15. TRICHLOR | (230° F./45 min) |
| 16. PERCHLOR | (230° F./45 min) |

The testing procedures for the above identified samples was as follows:

The test conditions were 72° F. and 63% relative humidity; an Instron CRE Type Tensile Tester was employed; a one-inch gauge length between jaws was established; a one-inch by one-inch serrated face jaw ms used; a one-inch by two-inch smooth back jaw was employed; the sample size was one-inch wide by 4.5 inches in length; the rate of fabric separation was 12 inches per minute. Three breaks for each direction of warp and filling were performed to obtains the average fabric strength. The data is reported in the following tables:

| FABRIC STRENGTH DATA AND AVERAGES (LBS.) | | | | |
|---|---|---|---|---|
| SAMPLE | WARP STRENGTH[1] | AVERAGE | FILLING STRENGTH[2] | AVERAGE |
| 1. | 54, 58, 55 | 55.7 | 35, 34.5, 36 | 35.2 |
| 2. | 53.5, 55.5, 53.5 | 54.2 | 34, 33.5, 33.5 | 33.7 |
| 3. | 52.5, 50.5, 54 | 52.3 | 32, 32.5, 33 | 32.5 |
| 4. | 47.5, 50, 48,5 | 48.8 | 31, 33, 33.5 | 32.4 |
| 5. | 50, 55.5, 50.5 | 52.0 | 28.5, 28, 29 | 28.5 |
| 6. | 55.5, 49, 55 | 53.2 | 31, 32.5, 32 | 31.8 |
| 7. | 55.5, 51, 53.5 | 53.3 | 35, 32, 34.5 | 33.8 |
| 8. | 52, 48.5, 52 | 50.8 | 33, 30, 31 | 32.0 |
| 9. | 52.5, 52.5, 55 | 53.3 | 32, 33, 30.5 | 31.8 |
| 10. | 50.5, 52, 48.5 | 50.3 | 32.5, 35.5, 32.5 | 33.5 |
| 11. | 45, 48, 51 | 48.0 | 35.5, 34.5, 37 | 35.7 |
| 12. | 46.5, 52.5, 46.5 | 48.5 | 36, 33, 33 | 34.0 |
| 13. | 43, 44, 43.5 | 43.5 | 34.5, 36, 36.5 | 35.7 |
| 14. | 45, 45, 42 | 44.0 | 43, 40.5, 41 | 41.5 |
| 15. | 42.5, 42.5, 45 | 43.3 | 33.5, 33, 32.5 | 33.0 |
| 16. | 41.5, 42, 47.5 | 43.7 | 34, 31.5, 32.5 | 32.7 |

[1]Strength in lengthwise direction of fabric.
[2]Strength in cross-direction

A satisfactory warf and fill strength of a wool fabric is normally between 55 and 60 lbs., is normally between 55 and 60 lbs., and 35–38 lbs., respectively. Unsatisfactory values would be a warp strength under 35 lbs., and a filling strength under 25 lbs. As can be seen from the above, the exposure to the indicated solvents at various temperatures and times in a sealed vessel did not significantly effect the mechanical strength of the wool material, and the wool material was therefore made substantially free of polyolefin contamination.

Finally, it will be appreciated that other variations and modifications of the invention can take place without departing from the scope of the appended claims.

I claim:

1. A process of producing purified fabric substantially free of polyolefin continuation comprising the steps of:

supplying a fabric containing polyolefin contamination;

selecting a solvent which solubilizes the polyolefin wherein said solvent solubilizes the polyolefin at temperatures and pressures that do not degrade the fabric;

treating the fabric with the selected solvent to solubilize said polyolefin; and removing the solvent containing polyolefin contamination and recovering the purified fabric.

2. The process of claim 1, wherein the fabric is selected from the group consisting of wool, cashmere, camel hair, alpaca and angora fiber.

3. The process of claim 1, wherein the polyolefin contamination is a polypropylene fiber.

4. The process of claim 1, wherein the solvent selected is a chlorinated hydrocarbon solvent.

5. The process of claim 4, wherein the solvent is trichloroethane.

6. The process of claim 1, wherein the temperature is about 175° to 235° F.

7. The process of claim 1, wherein the pressure is about 25–20 psi.

8. The process of claim 1, wherein the treatment of the fabric with solvent comprises continuous solvent extraction.

9. A process of producing purified wool fabric substantially free of polypropylene contamination comprising the steps of:

supplying a wool fabric containing polypropylene contamination;

treating said fabric with a chlorinated hydrocarbon solvent to solubilize the polyolefin characterized in that said treatment is conducted at a temperature and pressure that does not cause degradation to the fabric, and removing the solvent containing polyolefin contamination and recovering the purified fabric.

* * * * *

UNITED STATES PATENT AND TRADEMARK OFFICE

CERTIFICATE OF CORRECTION

PATENT NO. : 5,486,211

DATED : January 23, 1996

INVENTOR(S) : John L. GLIDDEN, Sr.

It is certified that error appears in the above-indentified patent and that said Letters Patent is hereby corrected as shown below:

Claim 1, Col. 6, line 3, "continuation" should be --contamination--.

Claim 7, Col. 6, line 24, "25-20" should be --25-200--.

Signed and Sealed this

Twenty-fifth Day of June, 1996

*Attest:*

Bruce Lehman

BRUCE LEHMAN

*Attesting Officer*

*Commissioner of Patents and Trademarks*